US006679088B2

(12) United States Patent
Hartel et al.

(10) Patent No.: US 6,679,088 B2
(45) **Date of Patent: *Jan. 20, 2004**

(54) LOCKING ARRANGEMENT

(75) Inventors: Marc Hartel, Reiskirchen (DE); Andreas Wiesemann, Wetter (DE)

(73) Assignee: Rittal GmbH & Co. KG, Herborn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/971,069

(22) Filed: Oct. 4, 2001

(65) Prior Publication Data

US 2002/0104341 A1 Aug. 8, 2002

(30) Foreign Application Priority Data

Oct. 5, 2000 (DE) ..... 100 49 637

(51) Int. Cl.[7] ..... E05B 13/00

(52) U.S. Cl. ..... 70/208; 70/213; 70/284; 70/285

(58) Field of Search ..... 70/208, 213, 284, 70/285, DIG. 63, 78, 219; 292/336.3, DIG. 31

(56) References Cited

U.S. PATENT DOCUMENTS

| | | | | | |
|---|---|---|---|---|---|
| 1,431,263 | A | * | 10/1922 | Shannon | |
| 1,613,550 | A | * | 1/1927 | Wildrick | |
| 3,107,513 | A | * | 10/1963 | Walston | |
| 3,633,388 | A | * | 1/1972 | Atkinson | 70/80 |
| 3,745,796 | A | * | 7/1973 | Fleming | 70/81 |
| 4,134,281 | A | * | 1/1979 | Pelcin | 70/208 |
| 5,063,764 | A | * | 11/1991 | Amis et al. | 70/100 |
| 5,345,798 | A | * | 9/1994 | Nakai | 70/284 |
| 5,347,834 | A | * | 9/1994 | Ramsauer | 70/120 |
| 5,692,403 | A | * | 12/1997 | Ling | 70/312 |
| 6,363,761 | B1 | * | 4/2002 | Sauerland | 70/208 |

FOREIGN PATENT DOCUMENTS

| | | | | |
|---|---|---|---|---|
| DE | 198 01 721 | | 4/1999 | |
| EP | 155 543 | | 7/1991 | |
| FR | 810381 | * | 3/1937 | 70/285 |
| FR | 1482991 | * | 6/1967 | 70/284 |
| FR | 2641952 | * | 7/1990 | 70/285 |
| JP | 403030088 | * | 2/1991 | 70/208 |
| JP | 404016682 | * | 1/1992 | 70/285 |

* cited by examiner

*Primary Examiner*—Lloyd A. Gall
(74) *Attorney, Agent, or Firm*—Pauley Petersen & Erickson

(57) ABSTRACT

A locking arrangement for a switchgear cabinet, having a holding device, which contains a manual lever in a handle receptacle. The manual lever can be arrested in a locked position on the holding device by a displaceably seated bolt. For actuating the bolt, the holding device, which is in operative contact with the bolt, contains a lock in a lock housing. To make a locking arrangement accessible with little cost to a limited and definite group of people in connection with switchgear cabinets, the holding device contains a secondary lock which is also in operative connection with the bolt, or the secondary lock is in operative connection with a second bolt by a second actuating member, wherein the second bolt arrests the manual lever in a blocking position on the holding device.

16 Claims, 2 Drawing Sheets

LOCKING ARRANGEMENT

BACKGROUND OF THE INVENTION

1. Field of the Invention

This invention relates to a locking arrangement for a switchgear cabinet, having a holding device, which contains a manual lever in a handle receptacle, wherein the manual lever can be arrested in a locked position on the holding device by a displaceably seated bolt and for actuating the bolt, the holding device, which is in operative contact with the bolt, contains a lock in a lock housing.

2. Description of Related Art

A locking arrangement of this type is known from German Patent Reference DE 198 01 721 C1. The manual lever of this locking arrangement is pivotally fastened in a holding device. The manual lever can be pivoted in a plane extending perpendicular with respect to the cabinet door to which the holding device is attached. In the initial position the manual lever is maintained in a lever receptacle. A bolt prevents the manual lever from being inadvertently moved into the open position. The bolt can be disengaged by a slide. The slide is actuated by a lock, for example a profiled semi-cylinder. As soon as the manual lever is disengaged, it can be grasped and pivoted into its open position.

A similar arrangement is also known from European Patent Reference EP 0 155 543 B1. A manual lever is also securely fixed in a handle receptacle. As soon as it is disengaged, it is snapped into an actuating position through the action of a spring element. It can be grasped there and pivoted around an axis of rotation extending perpendicular with respect to the cabinet door.

Switchgear cabinets are often used in switching distribution centers, for example telephone exchanges.

Besides the operators, third parties having leased individual switchgear cabinets, also have access to these distribution centers. It is thus necessary to regulate the right of access to the switchgear cabinets, wherein only authorized third parties are admitted, besides the operators.

SUMMARY OF THE INVENTION

One object of this invention is to provide a locking arrangement of the type mentioned above but where the right of access to a switchgear cabinet of two groups of users is regulated in a simple manner.

This object is achieved with a holding device that contains a secondary lock, which is also in operative connection with the bolt, or the secondary lock is in operative connection with a second bolt by a second actuating member, wherein the second bolt also arrests the manual lever in its blocking position to the holding device.

The locking arrangement can be attached to a switchgear cabinet door as a uniform component and combines two locking options. Thus, two different authorized user groups can obtain access to a switchgear cabinet.

In accordance with a preferred embodiment of this invention, the actuating member for operating the bolt is designed as a slide, which has actuating shoulders for the lock, as well as for the secondary lock. The lock and the secondary lock operate the slide with control members via the actuating shoulders. Thus it is possible to keep the cost for parts and assembly of the locking arrangement low, so that a simple construction is possible.

In a preferred manner the actuating member is produced as a stamped and bent part from a sheet metal blank. The actuating shoulders are then punched out of the actuating member and bent in the form of tabs.

In one embodiment of this invention, the secondary lock is housed interchangeably in a lock receiver of the lock housing which, when no secondary lock is installed, is capped by a cover. The cover is fastened on the inside of the lock housing. With this embodiment the locking arrangement can for example be available in a basic variation but can be retrofitted with the secondary lock at any time.

In a preferred manner, the secondary lock is designed as a number lock with adjustable number wheels. Thus the secondary lock has a rotary slide which supports the control member for operating the actuating shoulder. The rotary slide can be operated when the correct number code is set, but otherwise is blocked.

In order to prevent with a secondary lock that, following the opening of the switchgear cabinet, the number code is accidentally not reset, in one embodiment of this invention the rotary slide of the secondary lock operates a reset mechanism in the area of its displacement path, which brings the number wheels into a reset position.

If the lock and the secondary lock are kept together in the lock housing, and the lock housing can be installed on the holding device as a separate component, it is possible to retrofit the holding devices using the most diverse lock housings.

In accordance with another embodiment of this invention, in a locking arrangement the secondary lock is in operative connection with a second actuating member. The second actuating member is in operative connection with the second bolt. The bolt and the second bolt are maintained in the blocking position by spring bias and in the open position are displaceably seated opposite the spring bias by the actuating members. When the two bolts are maintained in the locking position, a so-called master function is realized. In this case it is necessary to actuate both locks for releasing the manual lever in the end.

BRIEF DESCRIPTION OF THE DRAWINGS

This invention is explained in greater detail in view of exemplary embodiments shown in the drawings, wherein.

DESCRIPTION OF PREFERRED EMBODIMENTS

Figure 1:
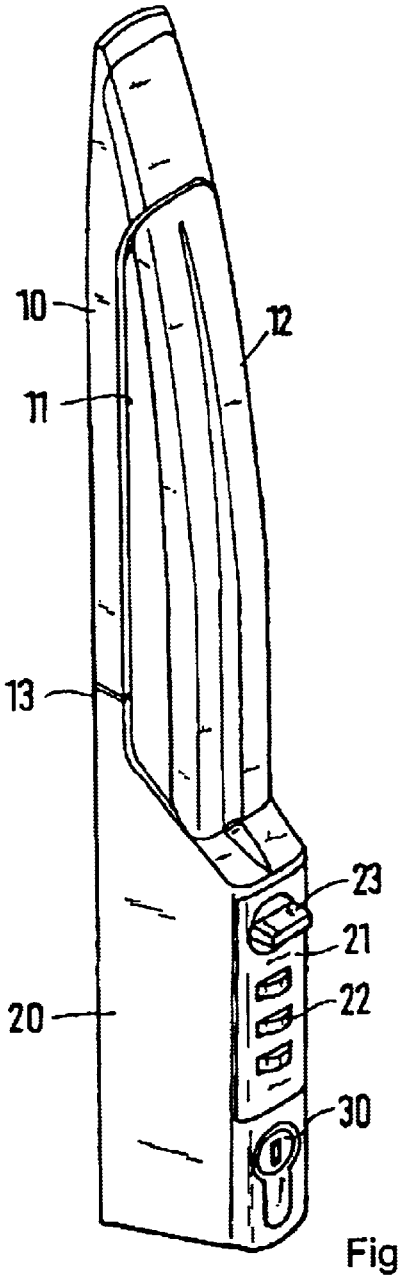
FIG. 1 shows a perspective lateral view of a locking arrangement for a switchgear cabinet.

A locking arrangement with a holding device 10 and a lock housing 20 is shown in FIG. 1. The holding device 10 forms a mechanical interface 13, on which the lock housing 20 can be installed. Together with the lock housing 20, the holding device 10 forms a handle receptacle 11. A manual lever 12 is arranged therein in its locked position.

The lock housing 20 has a lock 30 and a secondary lock 21, which are arranged on top of each other. The secondary lock 21 is designed as a number lock and has three adjustable number wheels 22. The secondary lock 21 also has a rotary slide 23, which can be grasped by a handle on its front and rotated.

Figure 2:
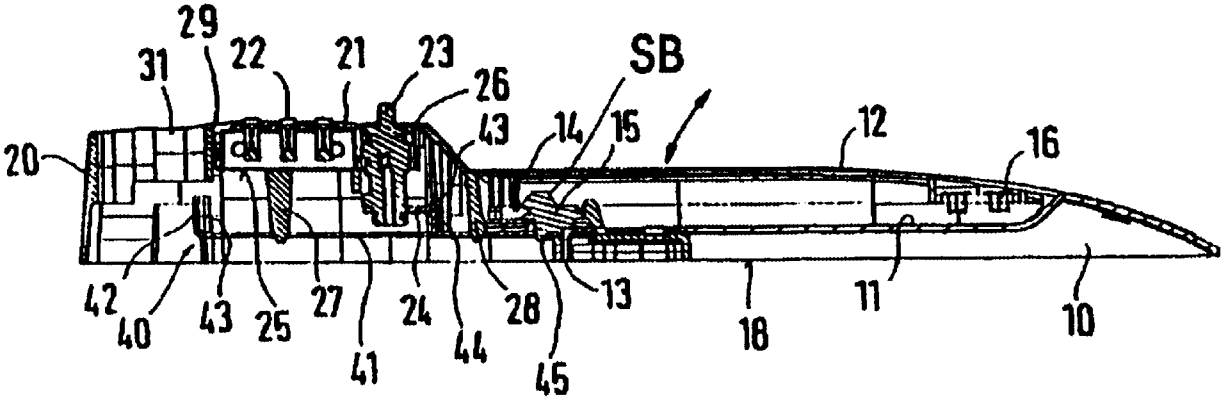
FIG. 2 shows a locking arrangement of FIG. 1 in a vertical section.

As shown in FIG. 2, the locking arrangement has a contact surface 18 with which it can be placed on the front of a switchgear cabinet door. In the installed state, the manual lever 12 is pivotally seated in a plane vertically with respect to the door plane. In the closed position shown in FIG. 2, the manual lever 12 is held in place in the handle receptacle 11 by means of a bolt 15. Thus, the bolt 15 extends behind a tumbler 14 of the manual lever 12. The bolt 15 itself is displaceably seated on the lock housing 20. An actuating member 40 is installed on the bolt 15. The actuating member 40 has a push rod 41, which is maintained on a support element 27 and a sliding bearing 28 of the lock housing 20, as shown in FIG. 2. The actuating member 40 can be displaced linearly and parallel with respect to the drawing plane and can be cut from a sheet steel blank in the form of a stamped and bent element. Actuating shoulders 42 are bent off the push rod 41. The actuating shoulders 42 and 44 project into the interior surrounded by the lock housing 20.

As shown in FIG. 2, the lock housing 20 has a lock receptacle 31 in which the lock 30 can be installed. The representation of the lock 30 is omitted in FIG. 2 for reasons of clarity. The secondary lock 21 is inserted into a lock receptacle 29 of the lock housing 20. Together with the components supporting the number wheels 22 and the rotary slide 23 it forms an assembly and can be handled as a unit and inserted into the corresponding lock receptacle. In the installed state, the secondary lock 21 is supported by its circumferential flange 26 in a recessed receiver in the lock housing 20. On the top, the flange 26 terminates flush with the visible face of the lock housing 20. Thus the insertion of a tool behind the flange and unauthorized operations performed on the locking arrangement are prevented. The secondary lock 21 has a resting surface 25, which faces the interior of the lock housing 20 and is supported on the support element 27. The secondary lock 21 can be fixed in place from a direction of the lock housing inside by means of fastening screws.

The rotary slide 23 has a control member 24 which is in operative contact with a second actuating shoulder 44 of the push rod 41. The second actuating shoulder 44 is in operative contact with a control member 24 of the lock, not shown in FIG. 2. For improved operability, the actuating shoulders 42 and 44 have lateral control cams 43. The control members 24 can run up on the control cams 43 when the lock is operated.

Either the lock 30 or the secondary lock 21 can be used for unlocking the manual lever 12. To operate the secondary lock it is first necessary to set a code on the number wheels 22. Then the rotary slide 23 can be rotated on an axis vertically with respect to the contact surface 18. In the process, the control member 24 slides up on the control cam 43 of the actuating shoulder 44. Thus the actuating member 40 is displaced toward the right in the drawing plane of FIG. 2. The displacement movement is performed against a spring, which holds the actuating member 40 under spring prestress. As soon as the bolt 15 releases the tumbler 14, the manual lever 12 pivots around the handle seat 16 out of the handle receptacle 11. The pivoting-out movement is assisted by a spring.

In place of operating the actuating member 40 by means of the secondary lock 21, an operation of the bolt 15 can also be performed by the lock 30. The lock 30 also has a control member 24, not shown in FIG. 2, which slides up on the control cam 43 of the actuating shoulder 42. In another embodiment of the invention, the secondary lock (21) is in operative connection with a second actuating member, preferably alongside the actuating member (40). The second actuating shoulder (44) is bent off the second actuating member. The second actuating member is in operative connection with a second bolt (SB) which in a blocking position arrests the manual lever (12). The second bolt is preferably the same size and shape as the bolt (15) and is positioned alongside the bolt (15). The bolt (15) and the second bolt are maintained in the blocking position by a spring force. In an open position the bolt (15) and the second bolt are displaceably seated opposite the spring force by the actuating member (40) and the second actuating member, respectively. Thus in this embodiment, it is necessary to actuate both locks for releasing the manual lever.

Figure 3:
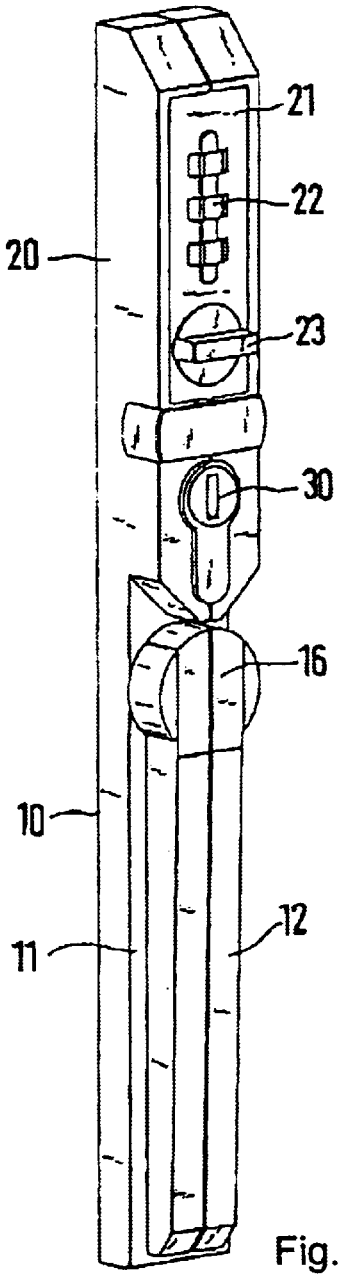
FIG. 3 shows a perspective lateral view of a further embodiment of a locking arrangement for a switchgear cabinet.
Figure 4:
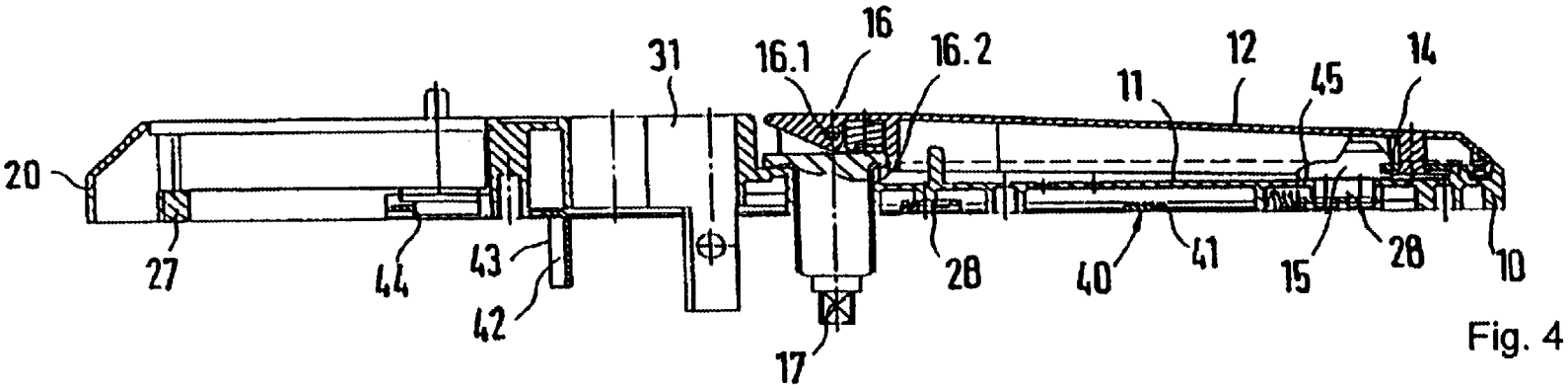
FIG. 4 shows a locking arrangement of FIG. 3 in a vertical section.

A further embodiment of a locking arrangement is shown in FIGS. 3 and 4. It is functionally constructed similar to the locking arrangements in accordance with FIGS. 1 and 2. In its locked position, the manual lever 12 is fixed in place in a handle receptacle 11 by means of a bolt 15, shown in FIG. 4. The actuating member 40, which is embodied in the shape of a frame, is coupled to the bolt 15. Similar to the locking arrangement in accordance with FIGS. 1 and 2, the actuating member 40 can again be triggered by two actuating shoulders 42, 44 selectively by a lock 30 or a secondary lock 21. When the bolt 15 is released, the manual lever 12 pivots out in a plane vertically with respect to the switchgear cabinet door. In this case the pivot movement takes place around the pivot bearing, identified by 16.1 in FIG. 4. In the pivoted-out state the manual lever 12 can be grasped and pivoted around a rotary bearing 16.2.

The pivot axis of the rotary bearing 16.2 can extend vertically with respect to the plane of the cabinet door. While rotating the manual lever 12, a bearing journal 17 rotates inside the rotary bearing 16.2. A locking rod system of the cabinet door can be moved with the aid of the rotation of the bearing journal 17.

What is claimed is:

1. In a locking arrangement for a switchgear cabinet, having a holding device which contains a manual lever in a handle receptacle, wherein the manual lever can be arrested in a locked position on the holding device by a displaceably seated bolt and for actuating the bolt the holding device which is in operative contact with the bolt contains a lock in a lock housing, the improvement comprising:

the holding device (10) containing the lock (30) which is in operative connection with the bolt (15);

the holding device (10) containing a secondary lock (21) which is in operative connection with the bolt (15); and the actuating member (40) for operating the bolt (15) is a slide with actuating shoulders (42, 44) for the lock (30) and for the secondary lock (21), and the lock (30) and the secondary lock (21) operate the slide with control members (24) by way of the actuating shoulders (42, 44).

2. In the locking arrangement in accordance with claim 1, wherein the actuating member (40) is produced as a stamped and bent part from a sheet metal blank, and the actuating shoulders (42,44) are punched out of the actuating member (40) and bent in the form of tabs.

3. In the locking arrangement in accordance with claim 2, wherein the secondary lock (21) is interchangeably fastened in a lock receiver of the lock housing (20), wherein the secondary lock (21) is removable from the lock housing (20) and exchangeable with a cover fastened on an inside of the lock housing (20).

4. In the locking arrangement in accordance with claim 3, wherein the secondary lock (21) is a number lock with adjustable number wheels (22).

5. In the locking arrangement in accordance with claim 4, wherein the secondary lock (21) has a rotary slide (23) which supports a control member (24) for operating one of the actuating shoulders (42, 44), and the rotary slide (23) is operated when a correct number code is set but otherwise is blocked.

6. In the locking arrangement in accordance with claim 5, wherein the rotary slide (23) of the secondary lock (21) operates a reset mechanism in an area of a displacement path which bring the number wheels (22) into a reset position.

7. In the locking arrangement in accordance with claim 1, wherein the secondary lock (21) is interchangeably fastened in a lock receiver of the lock housing (20), wherein the secondary lock (21) is removable from the lock housing (20) and exchangeable with a cover fastened on an inside of the lock housing (20).

8. In the locking arrangement in accordance with claim 1, wherein the secondary lock (21) is a number lock with adjustable number wheels (22).

9. In the locking arrangement in accordance with claim 8, wherein the secondary lock (21) has a rotary slide (23) which supports a control member (24) for operating an actuating shoulder (42, 44), and the rotary slide (23) is operated when a correct number code is set but otherwise is blocked.

10. In the locking arrangement in accordance with claim 9 wherein the rotary slide (23) of the secondary lock (21) operates a reset mechanism in an area of a displacement path which bring the number wheels (22) into a reset position.

11. In a locking arrangement for a switchgear cabinet, having a holding device which contains a manual lever in a handle receptacle, wherein the manual lever can be arrested in a locked position on the holding device by a displaceably seated bolt and for actuating the bolt the holding device which is in operative contact with the bolt contains a lock in a lock housing, the improvement comprising:

the holding device (10) containing the lock (30) which is in operative connection with the bolt (15); and the holding device (10) containing a secondary lock (21) in operative connection with a second actuating member, the second actuating member in operative connection with a second bolt wherein the second bolt in a blocking position arrests the manual lever (12), and the bolt (15) and the second bolt are maintained in the blocking position by a spring force and in an open position are displaceably seated opposite the spring force by an actuating member (40) and the second actuating member.

12. In the locking arrangement in accordance with claim 11, wherein the lock (30) and the secondary lock (21) are maintained together in the lock housing (20), and the lock housing (20) is installed on the holding device (10) as a separate component.

13. In the locking arrangement in accordance with claim 11, wherein the actuating member (40) for operating the bolt (15) is a slide with an actuating shoulder (42) for the lock (30) and the second actuating member for operating the second bolt is a second slide with a second actuating shoulder (44) for the secondary lock (21), and the lock (30) and the secondary lock (21) operate the slides with control members (24) by way of the actuating shoulders (42, 44).

14. In the locking arrangement in accordance with claim 13, wherein the actuating member (40) and the second actuating member are produced as a stamped and bent part from a sheet metal blank, and the actuating shoulders (42,44) are punched out of the actuating member (40) and second actuating member and bent in the form of tabs.

15. In the locking arrangement in accordance with claim 11, wherein the secondary lock (21) is a number lock with adjustable number wheels (22).

16. In the locking arrangement in accordance with claim 11, wherein the secondary lock (21) has a rotary slide (23) which supports a control member (24) for operating the second actuating shoulder (44), and the rotary slide (23) is operated when a correct number code is set but otherwise is blocked.

* * * * *